US011976652B2

(12) United States Patent
Wei et al.

(10) Patent No.: US 11,976,652 B2
(45) Date of Patent: May 7, 2024

(54) METHOD AND DEVICE FOR BALANCING CRANKSHAFT DEFORMATION, CRANKSHAFT, AND SCROLL COMPRESSOR

(71) Applicant: GREE GREEN REFRIGERATION TECHNOLOGY CENTER CO., LTD. OF ZHUHAI, Qianshan Zhuhai (CN)

(72) Inventors: Huijun Wei, Zhuhai (CN); Gang Lv, Zhuhai (CN); Caixia Shan, Zhuhai (CN); Shuanglai Liu, Zhuhai (CN); Qi Fang, Zhuhai (CN); Peng Ma, Zhuhai (CN); Yuchen Zhao, Zhuhai (CN)

(73) Assignee: Gree Green Refrigeration Technology Center Co., Ltd. of Zhuhai, Zhuhai (CN)

( * ) Notice: Subject to any disclaimer, the term of this patent is extended or adjusted under 35 U.S.C. 154(b) by 118 days.

(21) Appl. No.: 17/605,344

(22) PCT Filed: Dec. 26, 2019

(86) PCT No.: PCT/CN2019/128874
§ 371 (c)(1),
(2) Date: Oct. 21, 2021

(87) PCT Pub. No.: WO2020/215779
PCT Pub. Date: Oct. 29, 2020

(65) Prior Publication Data

US 2022/0228589 A1 Jul. 21, 2022

(30) Foreign Application Priority Data

Apr. 24, 2019 (CN) ..... 201910334854.6

(51) Int. Cl.
*F04C 18/02* (2006.01)
*F04C 23/00* (2006.01)
*F04C 29/00* (2006.01)

(52) U.S. Cl.
CPC ..... *F04C 18/0215* (2013.01); *F04C 23/008* (2013.01); *F04C 29/0021* (2013.01);
(Continued)

(58) Field of Classification Search
CPC .. F04C 18/0207–0292; F04C 2240/807; F04C 2230/605; F04C 29/0021; F04C 29/0057; F16C 3/04–30
See application file for complete search history.

(56) References Cited

U.S. PATENT DOCUMENTS

2013/0251567 A1* 9/2013 Wang ..... F04C 18/0215 418/55.5
2013/0340726 A1* 12/2013 Kach ..... F02B 33/38 123/559.1
2014/0227117 A1* 8/2014 Uekawa ..... F04C 18/0215 417/410.5

FOREIGN PATENT DOCUMENTS

CN 103814219 A 5/2014
CN 103827496 A 5/2014
(Continued)

OTHER PUBLICATIONS

Meter, Jeff J. and DeBlois, Raymond L., "Counterweighting Scroll Compressor for Minimal Bearing Loads" (1988). International Compressor Engineering Conference. Paper 618. https://docs.lib.purdue.edu/icec/618 (Year: 1988).*
(Continued)

*Primary Examiner* — Mark A Laurenzi
*Assistant Examiner* — Xiaoting Hu
(74) *Attorney, Agent, or Firm* — Christensen O'Connor Johnson Kindness PLLC

(57) ABSTRACT

Disclosed are a method and a device for balancing crankshaft deformation e, a crankshaft with counterweights deter-
(Continued)

mined according to the method, and a scroll compressor using the crankshaft. The method includes: determining a component centrifugal force required by a counterweight to overcome the crankshaft deformation caused by both an orbiting scroll centrifugal force and a gas force; and determining the counterweight according to the component centrifugal force. The counterweight is arranged on the crankshaft.

12 Claims, 8 Drawing Sheets

(52) U.S. Cl.
CPC .... *F04C 29/0057* (2013.01); *F04C 2230/605* (2013.01); *F04C 2240/807* (2013.01)

(56) References Cited

FOREIGN PATENT DOCUMENTS

| | | | |
|---|---|---|---|
| CN | 109312737 | A | 2/2019 |
| CN | 110080978 | A | 8/2019 |
| JP | 2004270654 | A | 9/2004 |

OTHER PUBLICATIONS

Shahane, V.C., Pawar, R.S. Optimization of the crankshaft using finite element analysis approach. Automot. Engine Technol. 2, 1-23 (2017). https://doi.org/10.1007/s41104-016-0014-0 (Year: 2017).*
International Search Report dated Apr. 1, 2020, issued in corresponding International Application No. PCT/CN2019/128874, filed Dec. 26, 2019, 2 pages.

* cited by examiner

METHOD AND DEVICE FOR BALANCING CRANKSHAFT DEFORMATION, CRANKSHAFT, AND SCROLL COMPRESSOR

RELATED APPLICATION

This application claims all benefits accruing under 35 U.S.C. § 119 from China Patent Application No. 201910334854.6, filed on Apr. 24, 2019 in the China National Intellectual Property Administration, the entire content of which is hereby incorporated by reference. This application is a national phase under 35 U.S.C. § 120 of international patent application PCT/CN2019/128874, entitled "Method and Device for Balancing Crankshaft Deformation, Crankshaft, and Scroll Compressor" filed on Dec. 26, 2019, the content of which is also hereby incorporated by reference.

TECHNICAL FIELD

The embodiments of the present disclosure relate to the field of scroll compressors, in particular, to a method and a device for balancing crankshaft deformation, a crankshaft, and a scroll compressor.

BACKGROUND

A shafting-balancing design of a high-speed scroll compressor has a greater impact on the vibration and noise of the whole machine, mainly because a shafting-balancing calculation method is based on the overall force balance and moment balance, and a solution satisfying the force balance and the moment balance is not necessary to satisfy the minimum deformation of the entire shafting, and deformation of a crankshaft is the main factor affecting the vibration and noise of the whole machine. In the related technology, the deformation caused by an orbiting scroll centrifugal force of the crankshaft is restrained and overcome, and the component force of the counterweight is determined to balance the crankshaft deformation during a high-speed operation, and the balance effect is poor.

In view of the above problems, no effective solutions have been proposed yet.

SUMMARY

Embodiments of the present disclosure provide a method and a device for balancing crankshaft deformation, a crankshaft and a scroll compressor, in order to address at least the technical problem that, in the related technology, only the influence of the orbiting scroll centrifugal force on the crankshaft is considered and the balance effect is poor.

According to an aspect of the embodiments of the present disclosure, a crankshaft deformation balancing method is provided, which includes: determining a component centrifugal force required for a counterweight to overcome the crankshaft deformation caused by both an orbiting scroll centrifugal force and a gas force; determining the counterweight according to the component centrifugal force; and balancing the crankshaft deformation by the counterweight. The counterweight is arranged on the crankshaft.

Optionally, before the determining the component centrifugal force required for the counterweight to overcome the crankshaft deformation caused by both the orbiting scroll centrifugal force and the gas force, the method further includes: determining the number and positions of counterweights on the crankshaft according to operating conditions of the crankshaft. The operating conditions includes at least one of an actual operating condition and a type of the crankshaft.

Optionally, before the determining the component centrifugal force required for the counterweight to overcome the crankshaft deformation caused by both the orbiting scroll centrifugal force and the gas force, the method further includes: determining a first crankshaft deformation caused by the orbiting scroll centrifugal force in a direction of an eccentric part of the crankshaft; and determining a second crankshaft deformation caused by the gas force of the crankshaft in a vertical direction perpendicular to the eccentric part of the crankshaft.

Optionally, the determining the component centrifugal force required for the counterweight to overcome the crankshaft deformation caused by both the orbiting scroll centrifugal force and the gas force includes: preliminarily determining a direction and a magnitude of the component centrifugal force required for the counterweight to overcome the orbiting scroll centrifugal force or the gas force according to the orbiting scroll centrifugal force or the gas force; carrying out a simulation by a simulation software, and adjusting the magnitude of the component centrifugal force to change the first deformation or the second deformation output by the simulation software; and determining the magnitude of the component centrifugal force corresponding to the orbiting scroll centrifugal force or corresponding to the gas force, when the first deformation or the second deformation reaches a preset value.

Optionally, the preliminarily determining the direction and the magnitude of the component centrifugal force required for the counterweight to overcome the orbiting scroll centrifugal force or the gas force according to the orbiting scroll centrifugal force or the gas force includes: determining the direction of the component centrifugal force according to the orbiting scroll centrifugal force or the gas force, wherein on the eccentric part of the crankshaft, a direction of the orbiting scroll centrifugal force is opposite to a direction of a component centrifugal force of an adjacent counterweight, and directions of the component centrifugal forces of two adjacent counterweights are opposite to each other; in the vertical direction perpendicular to the eccentric part of the crankshaft, a direction of the gas force is the same as a direction of a component centrifugal force of an adjacent counterweight, and the component centrifugal forces of two adjacent counterweights are opposite to each other; in the vertical direction of the eccentric part of the crankshaft, a direction of the gas force is the same as a direction of a component centrifugal force of an adjacent counterweight, and the component centrifugal forces of the two adjacent counterweights are opposite to each other; and according to a moment balance and a force balance between the orbiting scroll centrifugal force or the gas force and the component centrifugal force, preliminarily determining the magnitude of the component centrifugal force required for the counterweight to overcome the orbiting scroll centrifugal force or the gas force.

Optionally, the carrying out the simulation by the simulation software and adjusting the magnitude of the component centrifugal force to change the first deformation or the second deformation output by the simulation software includes: adjusting a ratio of the component centrifugal force to the orbiting scroll centrifugal force or to the gas force to adjust the magnitude of the component centrifugal force; and according to the adjusted component centrifugal force, changing the output first deformation or the second deformation.

Optionally, the determining the magnitude of the component centrifugal force corresponding to the orbiting scroll centrifugal force or corresponding to the gas force when the first deformation or the second deformation reaches the preset value includes: determining whether the first deformation or the second deformation is in a preset threshold range; if the first deformation or the second deformation is in the preset threshold range, determining the magnitude of the component centrifugal force corresponding to the orbiting scroll centrifugal force or corresponding to the gas force.

According to another aspect of the embodiments of the present disclosure, a crankshaft is further provided. The crankshaft includes at least one counterweight disposed on the crankshaft. The counterweight is determined according to any one of the methods described above.

Optionally, the crankshaft includes an eccentric part provided with an eccentric shaft and a motor fitting part. The eccentric part is provided with a first counterweight, the motor fitting part is provided with a second counterweight and a third counterweight. In a direction of the eccentric part of the crankshaft, a direction of a component centrifugal force of the first counterweight overcoming the orbiting scroll centrifugal force is opposite to a direction of the orbiting scroll centrifugal force, a direction of a component centrifugal force of the second counterweight overcoming the orbiting scroll centrifugal force is the same as the direction of the orbiting scroll centrifugal force, and a direction of a component centrifugal force of the third counterweight overcoming the orbiting scroll centrifugal force is opposite to the direction of the orbiting scroll centrifugal force. In a vertical direction perpendicular to the eccentric part of the crankshaft, a direction of a component centrifugal force of the first counterweight overcoming the gas force is opposite to a direction of the gas force, a direction of a component centrifugal force of the second counterweight overcoming the gas force is the same as the direction of the gas force, and a direction of a component centrifugal force of the third counterweight overcoming the gas force is opposite to the direction of the gas force.

Optionally, the R-directional upper counterweight satisfies that Fr1 is ranged from 1.2 Fc to 1.5 Fc, where Fr1 is a magnitude of the component centrifugal force of the R-directional upper counterweight overcoming the orbiting scroll centrifugal force, and Fc is a magnitude of the orbiting scroll centrifugal force.

Optionally, the T-directional middle counterweight satisfies that Ft2 is ranged from 1 Ft to 1.2 Ft, where Ft2 is a magnitude of the component centrifugal force of the T-directional middle counterweight overcoming the gas force, and Ft is a magnitude of the gas force.

According to another aspect of the embodiments of the present disclosure, a scroll compressor is further provided. The scroll compressor includes any one of the crankshafts described above.

According to another aspect of the embodiments of the present disclosure, a device for balancing crankshaft deformation is further provided. The crankshaft deformation balancing device includes: a first determining module configured to determine a component centrifugal force required for a counterweight to overcome crankshaft deformation caused by both an orbiting scroll centrifugal force and a gas force; a second determining module configured to determine the counterweight according to the component centrifugal force; a balancing module configured to balance the crankshaft deformation by means of the counterweight. The counterweight is disposed on the crankshaft.

According to another aspect of the embodiments of the present disclosure, a storage medium is further provided. The storage medium includes a stored program. When the program is executed, a device where the storage medium is located is controlled to perform any one of the methods described above.

According to another aspect of the embodiments of the present disclosure, a processor configured to run a program is further provided. When the program is executed, any one of the methods described above is performed.

In the embodiments of the present disclosure, by the means of determining the component centrifugal force required for each counterweight to overcome the crankshaft deformation caused by both the orbiting scroll centrifugal force and the gas force, the counterweight is determined according to the component centrifugal force, the crankshaft deformation is balanced by the counterweight, where the counterweight is disposed on the crankshaft. By considering the superimposed effect of the orbiting scroll centrifugal force and the gas force on the crankshaft deformation, the counterweight is determined, thus achieving the purpose of enabling the counterweight to more accurately balance the crankshaft deformation, achieving the technical effect of improving the balance effect of the counterweight on the crankshaft deformation, and solving the technical problem that, in the related technology, only the influence of the orbiting scroll centrifugal force on the crankshaft is considered and the balance effect is poor.

BRIEF DESCRIPTION OF THE DRAWINGS

Attached drawings illustrated herein, forming a part of the present disclosure, are used to provide a further understanding of embodiments of the present disclosure, and exemplary embodiments of the present disclosure and descriptions thereof are used to illustrate the embodiments of the present disclosure, but not constitute an improper limitation on the present disclosure. In the drawings.

Figure 1:
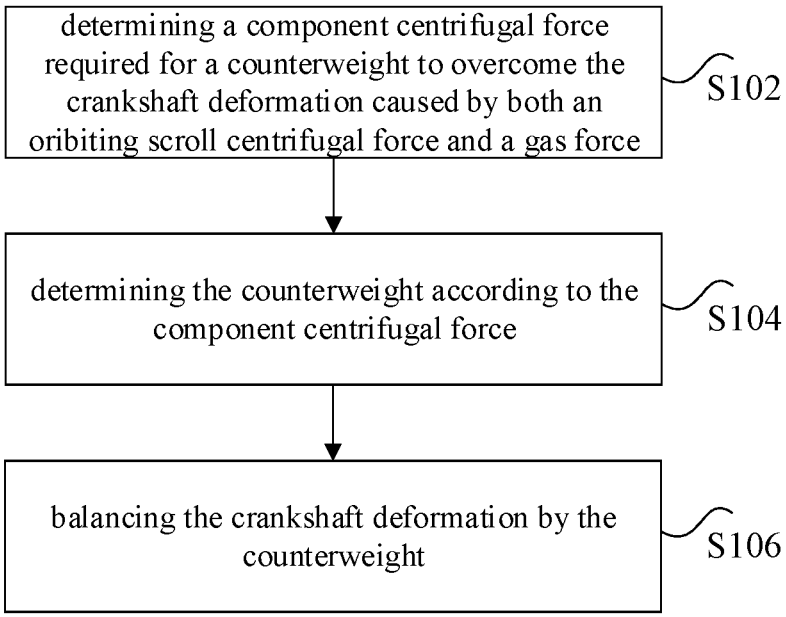
FIG. 1 is a flowchart of a method for balancing crankshaft deformation according to an embodiment of the present disclosure.

In which, the drawings include the following reference numerals:

1—gas inlet, 2—gas outlet, 3—upper cover, 4—lower cover, 5—fixed scroll, 6—orbiting scroll, 7—cross slip ring, 8—upper bracket, 9—crankshaft, 10—motor stator, 11—motor rotor, 12—oil pump, 13—supporting ring, 14—lower bracket, 15—middle balance block, 16—lower balance block, 17—upper balance block, 18—housing, 19—main shaft, 20—eccentric shaft, 15-1—R—directional middle counterweight, 16-1—R-directional lower counterweight, 17-1—R-directional upper counterweight, 15-2—T-directional middle counterweight, 16-2—T-directional lower counterweight, 17-2—T-directional upper counterweight.

DETAILED DESCRIPTION OF THE EMBODIMENTS

In order to enable those skilled in the art to better understand the solutions of the embodiments of the present disclosure, the technical solutions in the embodiments of the present disclosure will be described clearly and completely in conjunction with the accompanying drawings in the embodiments of the present disclosure. Apparently, the described embodiments are only a part of the embodiments of this disclosure, not all the embodiments. Based on the embodiments in this disclosure, all other embodiments obtained by those of ordinary skill in the art without creative work should fall within the protection scope of this disclosure.

It should be noted that terms "first", "second" and the like in the description, claims and drawings of the embodiments of the present disclosure are used to distinguish similar objects, and are not necessarily used to describe a specific order or sequence. It should be understood that the order numbers used in this way can be interchanged where appropriate, so that the embodiments of the present disclosure described herein can be implemented in an order other than those illustrated or described herein. In addition, terms "including" and "having" and any variations thereof are intended to cover non-exclusive inclusions. For example, a process, a method, a system, a product, or a device that includes a series of steps or units is not necessarily limited to the steps or units clearly listed, and may include other steps or units that are not clearly listed or are inherent to the process, the method, the product, or the device.

According to the embodiments of the present disclosure, a method embodiment of a method for balancing crankshaft deformation is provided. It should be noted that steps shown in a flowchart of the accompanying drawings may be a set of computer-executable instructions performed in a computer system. In addition, although the logical sequences are shown in the flowchart, in some cases, the steps shown or described may be performed in an order different from the one described herein.

FIG. 1 is a flowchart of a method for balancing crankshaft deformation according to an embodiment of the present disclosure. As shown in FIG. 1, the method includes the following steps of S102 to S106.

At Step S102, a component centrifugal force required for a counterweight to overcome crankshaft deformation caused by both an orbiting scroll centrifugal force and a gas force is determined.

At Step S104, the counterweight is determined according to the component centrifugal force.

At Step S106, the crankshaft deformation is balanced by the counterweight.

The counterweight is arranged on the crankshaft.

Through the above steps, by the means of determining the component centrifugal force required for each counterweight to overcome the crankshaft deformation caused by both the orbiting scroll centrifugal force and the gas force, the counterweight is determined according to the component centrifugal force, the crankshaft deformation is balanced by the counterweight, where the counterweight is arranged on the crankshaft. By considering the superimposed effect of the orbiting scroll centrifugal force and the gas force on the crankshaft deformation, the counterweight is determined, thus achieving the purpose of enabling the counterweight to more accurately balance the crankshaft deformation, achieving the technical effect of improving the balance effect of the counterweight on the crankshaft deformation, and solving the technical problem that, in the related technology, only the influence of the orbiting scroll centrifugal force on the crankshaft is considered and the balance effect is poor.

The crankshaft may deform due to external forces or its own structure during a high-speed rotation. In this embodiment, the orbiting scroll centrifugal force and the gas force are the two resistances that mainly affect the crankshaft deformation. The orbiting scroll centrifugal force is caused by the asymmetric structure of the crankshaft itself. Specifically, in the scroll compressor, an orbiting scroll gyrates, and its radius of the gyration is the eccentricity of the crankshaft. A centripetal force is generated during the gyration of the orbiting scroll. The centrifugal force corresponding to the centripetal force of the orbiting scroll becomes the centrifugal force of the orbiting scroll, also known as the orbiting scroll centrifugal force. The gas force is generated by the operating environment of the crankshaft. The crankshaft may be applied in a scroll compressor, and together with the gas in the compressor, generates the gas force, which affects the balanced rotation of the crankshaft, thus causing the crankshaft to be deformed. Specifically, in the scroll compressor, when the orbiting scroll and a fixed scroll compress the gas, the reaction forces of the gas are applied on the orbiting scroll and the fixed scroll, thus generating the gas force which acts on the crankshaft, and causes the crankshaft to be deformed.

The determining the component centrifugal force required for each counterweight to overcome the crankshaft deformation caused by the orbiting scroll centrifugal force and the gas force may include determining a first component centrifugal force of the counterweight overcoming the orbiting scroll centrifugal force, and a second component centrifugal force of the counterweight overcoming the gas force, respectively. The component centrifugal force is the resultant force of the first component centrifugal force and the second component centrifugal force. The determining the component centrifugal force required for each counterweight to overcome the crankshaft deformation caused by the orbiting scroll centrifugal force and the gas force may also include firstly determining a resultant force of the orbiting scroll centrifugal force and the gas force, and then determining the component centrifugal force required for the counterweight to overcome the resultant force.

For the determining the counterweight according to the component centrifugal force, after the component centrifugal force of the counterweight is determined, the centrifugal force of the counterweight is determined according to the component centrifugal force of the counterweight, and the counterweight is determined according to the centrifugal force. For the determining the component centrifugal force required for each counterweight to overcome the crankshaft deformation caused by the orbiting scroll centrifugal force and the gas force, the component centrifugal force may be calculated by applying the scroll component centrifugal force and the gas force in a fixed direction, which is convenient for calculation, and the calculation result is accurate. For example, the orbiting scroll centrifugal force is applied in a direction of an eccentric part of the crankshaft, and the gas force is applied in a direction perpendicular to the eccentric part of the crankshaft.

The counterweight is arranged on the crankshaft, and one or more counterweights may be provided. The specific number of the counterweights depends on the requirement of the crankshaft for the counterweights and operating conditions of the crankshaft. For the same crankshaft, the higher the working speed, the heavier the counterweight required for balancing the deformation. The counterweights may be distributed on the crankshaft. The more uniform the counterweights are distributed on the crankshaft, the more stable the balancing state of the crankshaft during a high-speed rotation. On the contrary, the more concentrated the counterweights are on the crankshaft, the easier it is to break the balancing state of the crankshaft during a high-speed rotation. When the crankshaft operates specifically, some parts thereof need to be fixed, and thus at least two fixing positions on the crankshaft are required to be fixed on a frame to ensure the rotation of the crankshaft. The counterweight cannot be provided at a mounting position of the crankshaft, otherwise, the crankshaft cannot be mounted. In addition, different parts of the crankshaft have different spaces during operation, and accordingly, volumes of the counterweights are configured to be different. Therefore, it is necessary to consider the specific working conditions of the crankshaft to determine the counterweights. In addition, the counterweights of the crankshaft may be arranged on the crankshaft, or may be fixed on the crankshaft by welding or other means. In the case that the counterweights are fixed on the crankshaft, process procedures of assembly and disassembly, or fixing of the counterweights need to be considered, otherwise, the previous configuration may be in vain.

In some embodiments of the present disclosure, before the determining the component centrifugal force required for each counterweight to overcome the crankshaft deformation caused by the orbiting scroll centrifugal force and the gas force, the method includes: determining the number and the positions of counterweights on the crankshaft according to the operating conditions of the crankshaft. The operating conditions include at least one of the actual operating condition and the type of the crankshaft. The actual operating condition may include various parameters of the crankshaft during operation, such as the rotational speed of the crankshaft and the rotational speed of the motor that drives the crankshaft. The types of crankshafts may be classified into, such as a stepped eccentric shaft and an eccentric optical shaft, according to the shape and structure of the crankshaft, or may be classified according to the service conditions of the crankshaft. For example, the crankshaft used in the scroll compressor is a crankshaft of the scroll compressor. The actual operating condition of the crankshaft of the scroll compressor may include: the rotational speed of the compressor (10 rpm to 160 rpm), the centrifugal force generated by the orbiting scroll disposed at the eccentric part of the crankshaft being greater than 3000N, and the tangential gas force borne by the orbiting scroll being greater than 3500N.

Optionally, before the determining the component centrifugal force required for each counterweight to overcome the crankshaft deformation caused by the orbiting scroll centrifugal force and the gas force, the method further includes: determining a first crankshaft deformation caused by the orbiting scroll centrifugal force in the direction of the eccentric part of the crankshaft; and determining a second crankshaft deformation caused by the gas force in the vertical direction of the eccentric part of the crankshaft.

By determining the first crankshaft deformation caused by the orbiting scroll centrifugal force in the direction of the eccentric part of the crankshaft, the influence of the orbiting scroll centrifugal force on the crankshaft deformation is determined. The first crankshaft deformation may have a functional relationship with the magnitude of the orbiting scroll centrifugal force. Similarly, by determining the second crankshaft deformation caused by the gas force in the vertical direction of the eccentric part of the crankshaft, the influence of the gas force on the crankshaft deformation is determined, and the second crankshaft deformation may have a functional relationship with the magnitude of the gas force.

Optionally, the determining the component centrifugal force required for each counterweight to overcome the crankshaft deformation caused by both the orbiting scroll centrifugal force and the gas force includes: preliminarily determining the direction and the magnitude of the component centrifugal force required for the counterweight to overcome the orbiting scroll centrifugal force or the gas force according to the orbiting scroll centrifugal force or the gas force; carrying out a simulation by means of a simulation software, and adjusting the magnitude of the component centrifugal force to change the first deformation or the second deformation output by the simulation software; and determining the magnitude of the component centrifugal force corresponding to the orbiting scroll centrifugal force or corresponding to the gas force, when the first deformation or the second deformation reaches a preset value.

The simulation software may be ANSYS software. As described above, when the first deformation or the second deformation reaches the preset value, the magnitude of the component centrifugal force is determined. It may be the case that the first deformation or the second deformation is equal to zero, or the case that the first deformation or the second deformation is in a certain numerical range including zero. The preliminarily determining the direction and the magnitude of the component centrifugal force required for the counterweight to overcome the orbiting scroll centrifugal force or the gas force according to the orbiting scroll centrifugal force or the gas force includes: preliminarily determining the magnitude of the component centrifugal force of the counterweight in a balanced state, simulating the component centrifugal force in the simulation software to determine an optimal solution of the component centrifugal force. Corresponding to the component centrifugal force, the first or second crankshaft deformation output by the simulation software is relatively small, and the balanced state is stable. The magnitude of the component centrifugal force corresponding to the orbiting scroll centrifugal force is determined according to the first deformation, and the magnitude of the component centrifugal force corresponding to the gas force is determined according to the second deformation.

In this embodiment, the preliminarily determining the direction and the magnitude of the component centrifugal force required for the counterweight to overcome the orbiting scroll centrifugal force or the gas force according to the orbiting scroll centrifugal force or the gas force includes: determining the direction of the component centrifugal force according to the orbiting scroll centrifugal force or the gas force, where on the eccentric part of the crankshaft, the direction of the orbiting scroll centrifugal force is opposite to the direction of the component centrifugal force of an adjacent counterweight, and the directions of the component centrifugal forces of two adjacent counterweights are opposite to each other, wherein in the vertical direction perpendicular to the eccentric part of the crankshaft, the direction of the gas force is the same as the direction of the component centrifugal force of an adjacent counterweight, and the component centrifugal forces of two adjacent counterweights are opposite to each other; according to the moment balance and the force balance between the orbiting scroll centrifugal force or the gas force and the component centrifugal force, preliminarily determining the magnitude of the component centrifugal force required for the counterweight to overcome the crankshaft deformation caused by the orbiting scroll centrifugal force or the gas force.

Optionally, the carrying out the simulation by means of the simulation software and adjusting the magnitude of the component centrifugal force to change the first deformation or the second deformation output by the simulation software includes: adjusting a ratio of the component centrifugal force to the orbiting scroll centrifugal force or to the gas force to adjust the magnitude of the component centrifugal force; and according to the adjusted component centrifugal force, changing the output first deformation or second deformation.

Before adjusting the simulation software, an adjusted object is determined according to the relationship between the first deformation or the second deformation and the component centrifugal force. For example, in the case that the deformation is proportional to the square of the component centrifugal force, if the deformation is determined by adjusting the component centrifugal force, it is difficult to determine the regular adjusting relationship between the component centrifugal force and the deformation, which makes a post-data processing inconvenient, and results in a relatively large error of a generated image. However, if the square of the component centrifugal force severs as the adjusted object, the deformation is proportional to this independent variable, therefore a post-data processing is convenient, and the error of the post-data processing is small. In this embodiment, the crankshaft deformation is proportional to the ratio of the component centrifugal force to the orbiting scroll centrifugal force or the gas force. Therefore, in this embodiment, the ratio of the component centrifugal force to the orbiting scroll centrifugal force or the gas force serves as the adjusted object.

Specifically, by adjusting the ratio of the component centrifugal force to the orbiting scroll centrifugal force, the first deformation output by the simulation software is changed. Alternatively, by adjusting the ratio of the component centrifugal force to the gas force, the second deformation output by the simulation software is changed.

Optionally, the determining the magnitude of the component centrifugal force corresponding to the orbiting scroll centrifugal force or corresponding to the gas force when the first deformation or the second deformation reaches the preset value includes: determining whether the first deformation or the second deformation is in a preset threshold range; and if the first deformation or the second deformation is in the preset threshold range, determining the magnitude of the component centrifugal force corresponding to the orbiting scroll centrifugal force or corresponding to the gas force.

The description describing whether the first deformation or the second deformation is within the preset threshold range may refer to whether the first deformation and the second deformation are within a certain range around zero, for example, from −0.02 mm to 0.02 mm, from −0.01 mm to 0.01 mm, or other values within the numeral range from 0.01 mm to 0.02 mm greater than or less than zero. The crankshaft deformation varies in different parts. In this embodiment, the crankshaft deformation is mainly divided into the deformation of the eccentric part and the deformation of the motor fitting part. The description describing whether the first deformation and the second deformation are within the preset threshold range may refer to determining whether deformation components of the first deformation or deformation components of the second deformation, which are on the eccentric part and the motor fitting part of the crankshaft respectively, are zero. The deformation components of the first deformation on the eccentric part and on the motor fitting part of the crankshaft may be a first deformation component and a second deformation component, respectively, and the deformation components of the second deformation on the corresponding eccentric part and on the motor fitting part of the crankshaft may be a third deformation component and a fourth deformation component, respectively. In the case that the deformation components on the eccentric part and on the motor fitting part of the crankshaft are zero, that is, the first deformation component and the second deformation component are both equal to zero, or the third deformation component and the fourth deformation component are both equal to zero, the magnitude of the component centrifugal force is determined. In actual operating conditions, the structures and conditions of borne forces of the eccentric part and the motor fitting part are different from each other, which makes it difficult for the deformation components on the eccentric part and the motor fitting part to be zero at the same time. Therefore, in this embodiment, the determining whether the deformation components on the eccentric part and the motor fitting part of the crankshaft are zero, may also refer to determining whether the deformation components on the eccentric part and the motor fitting part of the crankshaft are within a certain range around zero. If the deformation components are within the certain range around zero, the magnitude of the component centrifugal force may be determined.

In addition, after the magnitude of the component centrifugal force is determined, a range of the component centrifugal force may be determined according to the component centrifugal force.

It should be noted that this embodiment also provides an optional implementation, which will be described in detail hereafter.

This implementation provides a shafting-balancing design method during high-speed scroll operation. On the basis of a shafting balance, the crankshaft deformation may be minimum. The technical problems solved by this implementation are as follows: 1. a flexural deformation of the crankshaft during a high-speed rotation is large; 2. noise of vibration of the whole machine during the high-speed rotation is large. The beneficial effects achieved by this implementation are that the flexural deformation of the crankshaft of the scroll compressor during the high-speed rotation is small, and that the noise of the vibration of the whole machine is reduced.

The inventive points of this implementation are as follows. In an R direction, an upper counterweight is used to restrain the influence of the orbiting scroll centrifugal force on the crankshaft deformation. In a T direction, the middle counterweight is used to restrain the influence of the gas force on the crankshaft deformation. Fr1 is from 1.2 to 1.5 Fc, and Ft2 is from 1 Ft to 1.2 Ft. In the R direction, the upper counterweight is arranged to be opposite to the direction of the orbiting scroll centrifugal force. In the T direction, the middle counterweight is arranged in the same direction as the gas force.

Figure 2:
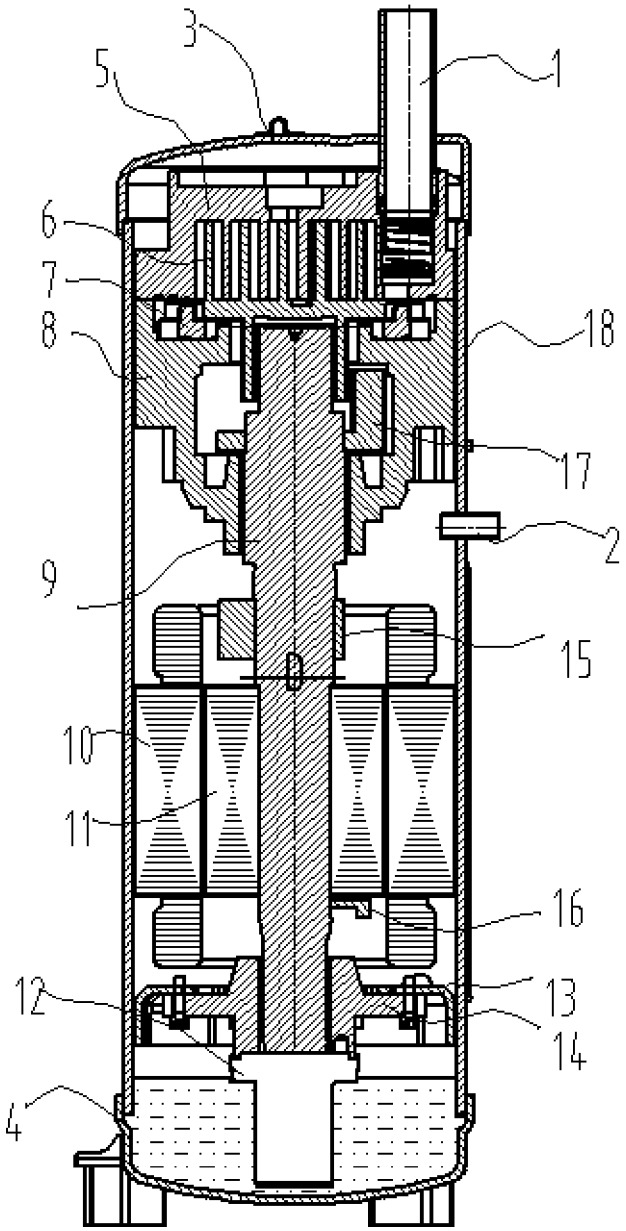
FIG. 2 is a schematic view of a scroll compressor according to an embodiment of the present disclosure.

FIG. 2 is a schematic view of a scroll compressor according to an embodiment of the present disclosure. As shown in FIG. 2, which is a structural schematic diagram of a high-speed scroll compressor. Low-temperature and low-pressure refrigerant passes through a gas inlet 1 and enters a compressing chamber formed by a fixed scroll 5 and an orbiting scroll 6. A motor drives an eccentric crankshaft 9 to rotate. The motor includes a motor stator 10 and a motor rotor 11. The eccentric crankshaft 9 drives the orbiting scroll 6 to move in translation. As the orbiting scroll moves in translation, the compressing chamber moves inward from the outer periphery, and the volume of the compressing chamber gradually decreases. The low-temperature and low-pressure refrigerant is compressed to form high-temperature and high-pressure refrigerant, and then is discharged from a center hole of the fixed scroll 5 to the inside of a housing 18, and finally discharged from a gas outlet 2 of the housing 18.

Reference numerals illustration: the R direction refers to a direction of the eccentric part of the crankshaft; the T direction refers to a vertical direction perpendicular to the eccentric part of the crankshaft; Fc, Fr1, Fr2, Fr3 are distributed in the R direction of the crankshaft; and Ft, Ft1, Ft2, Ft3 are distributed in the T direction of the crankshaft.

Figure 3:
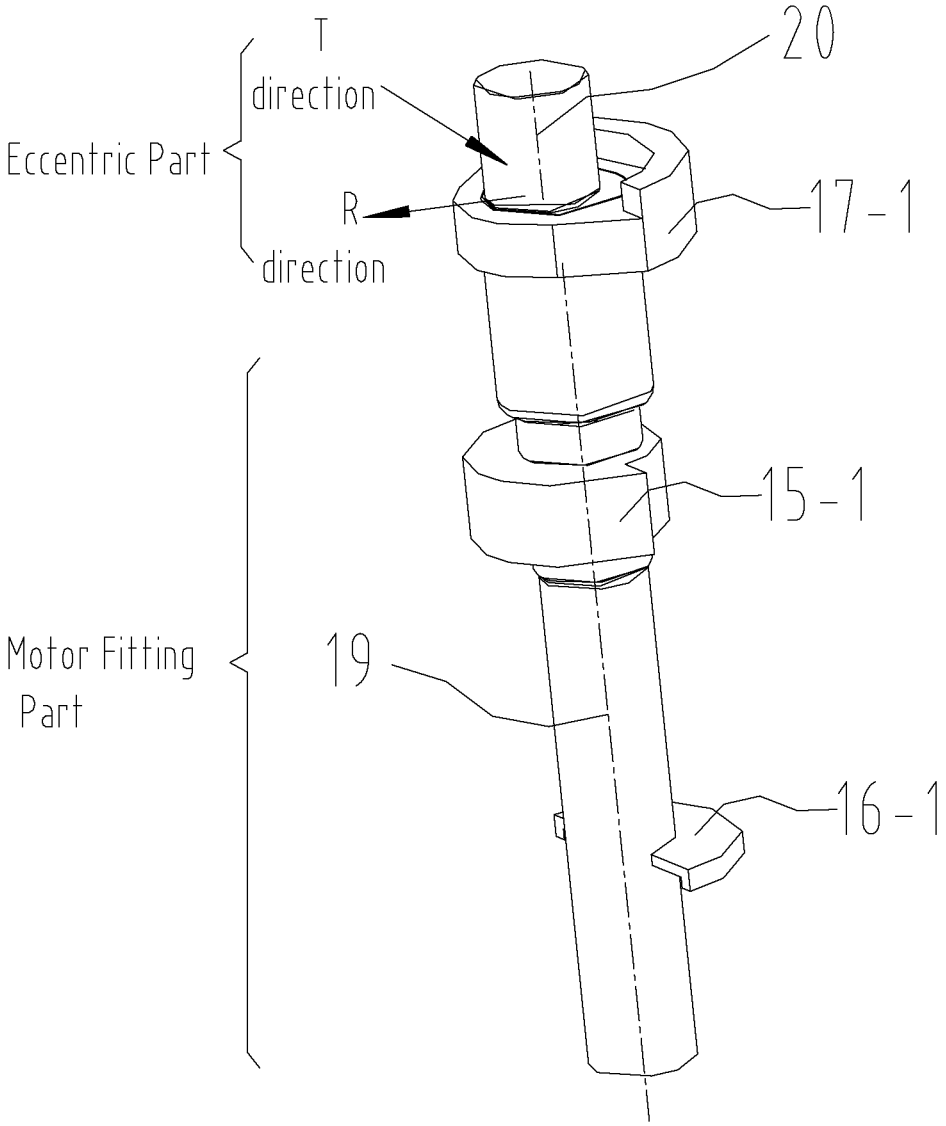
FIG. 3 is a schematic view illustrating a distribution of R-directional counterweights of a crankshaft according to an embodiment of the present disclosure.
Figure 4:
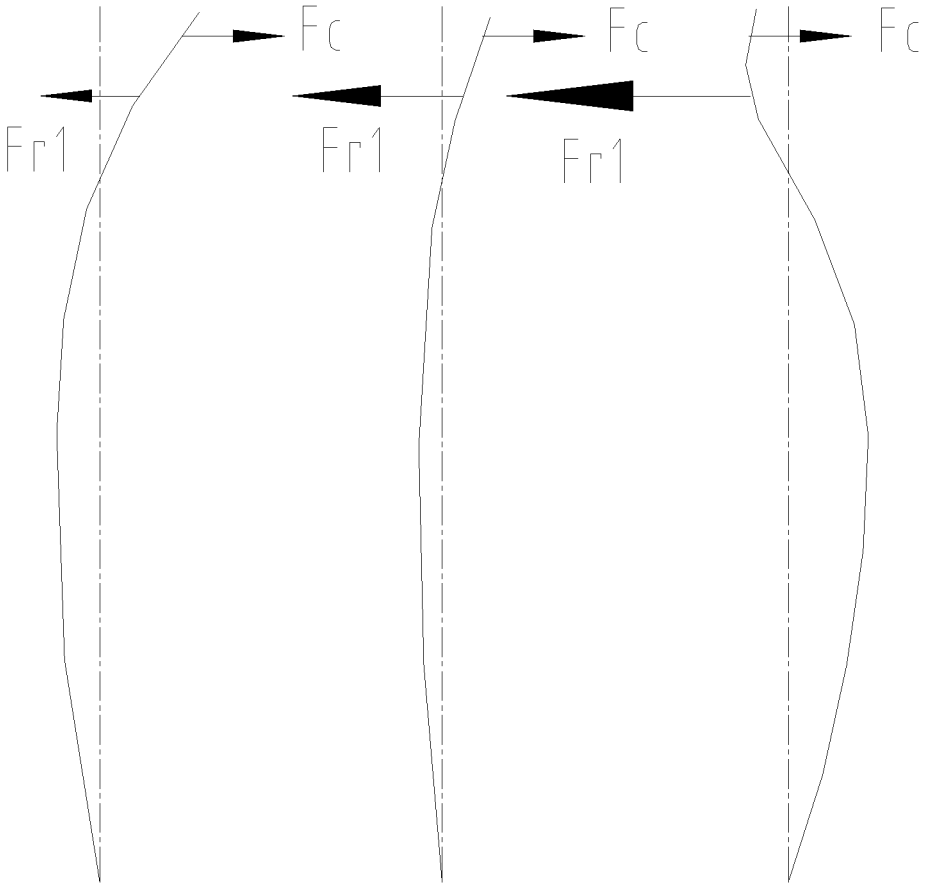
FIG. 4 is a schematic view illustrating flexure deformation under an R-directional centrifugal force according to an embodiment of the present disclosure.
Figure 5:
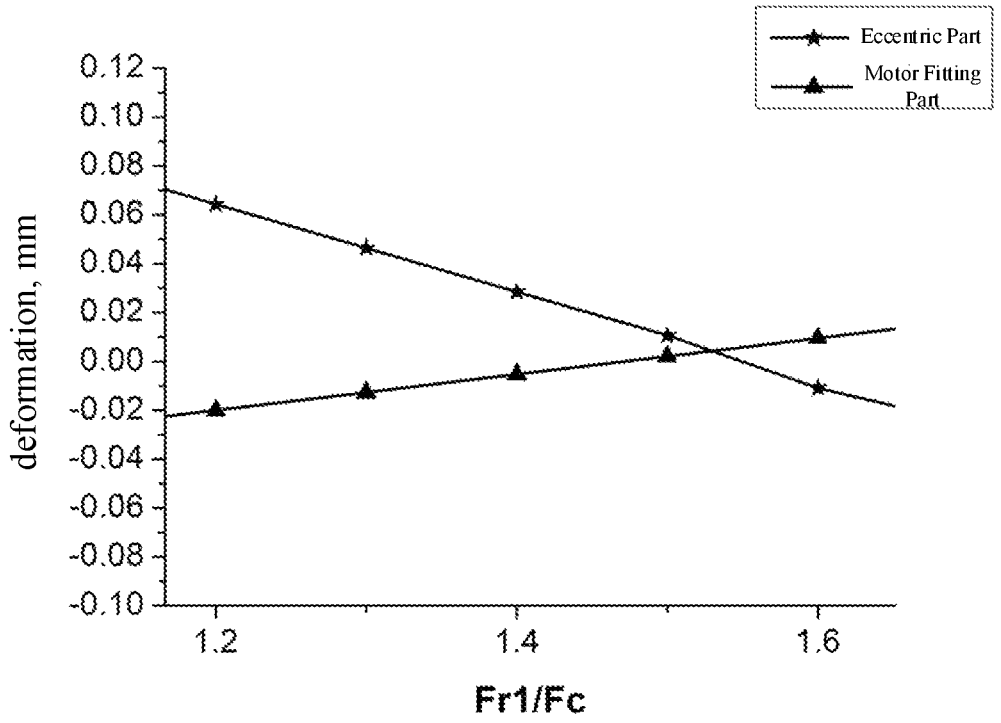
FIG. 5 is a view illustrating polygonal lines of calculated values of flexure deformation restrained by R-directional centrifugal forces according to an embodiment of the present disclosure.

FIG. 3 is a schematic view illustrating a distribution of R-directional counterweights of a crankshaft according to an embodiment of the present disclosure. As shown in FIG. 3, in the R direction of the crankshaft, the direction of the orbiting scroll centrifugal force Fc is opposite to the direction of the eccentric part. During a high-speed rotation, the orbiting scroll centrifugal force Fc is relatively large. An R-directional upper counterweight 17-1, an R-directional middle counterweight 15-1, and an R-directional lower counterweight 16-1 are arranged. The direction of the centrifugal force Fr1 of the R-directional upper counterweight 17-1 is opposite to the direction of the eccentric part of the crankshaft. The direction of the centrifugal force Fr2 of the R-directional middle counterweight 15-1 is the same as the direction of the eccentric part of the crankshaft. The direction of the centrifugal force Fr3 of the R-directional lower counterweight 16-1 is opposite to the direction of the eccentric part of the crankshaft. Fc, Fr1, Fr2, Fr3 satisfy the force balance and the moment balance in the R direction of crankshaft. The orbiting scroll centrifugal force Fc causes a flexure of the crankshaft. The centrifugal force Fr1 of the R-directional upper counterweight is arranged to be opposite to Fc. A simple supporting beam structure is adopted, and the ANSYS software is used to calculate a deformation trend of the crankshaft in the R direction. FIG. 4 is a schematic view illustrating flexure deformation under a centrifugal force in the R direction according to an embodiment of the present disclosure. As shown in the simply supporting beam structure in FIG. 4, the ratio Fr1/Fc increases from left to right. When Fr1/Fc is relatively small, the crankshaft bends towards the right, and when Fr1/Fc is relatively large, the crankshaft bends towards the left. FIG. 5 is a view illustrating polygonal lines of calculated values of flexure deformation restrained by R-directional centrifugal forces according to an embodiment of the present disclosure. As shown in FIG. 5, when Fr1/Fc=1.5, the deformation component of the eccentric part of the crankshaft and the deformation component of the motor fitting part are equal to each other, and are approximate to zero. In this case, the deformations of these two parts are relatively small, and the R-directional deformation of the crankshaft during a high-speed rotation is smallest. On the contrary, when Fr1/Fc>1.5, it is called "over-balance". In this case, the centrifugal force of the upper counterweight 17-1 is relatively large and the mass thereof is relatively heavy, and the counterweight arranged in the same direction will aggravate the R-directional deformation of the crankshaft. In the embodiment of the present disclosure, the counterweight Fr1 is from 1.2 Fc to 1.5 Fc.

Figure 6:
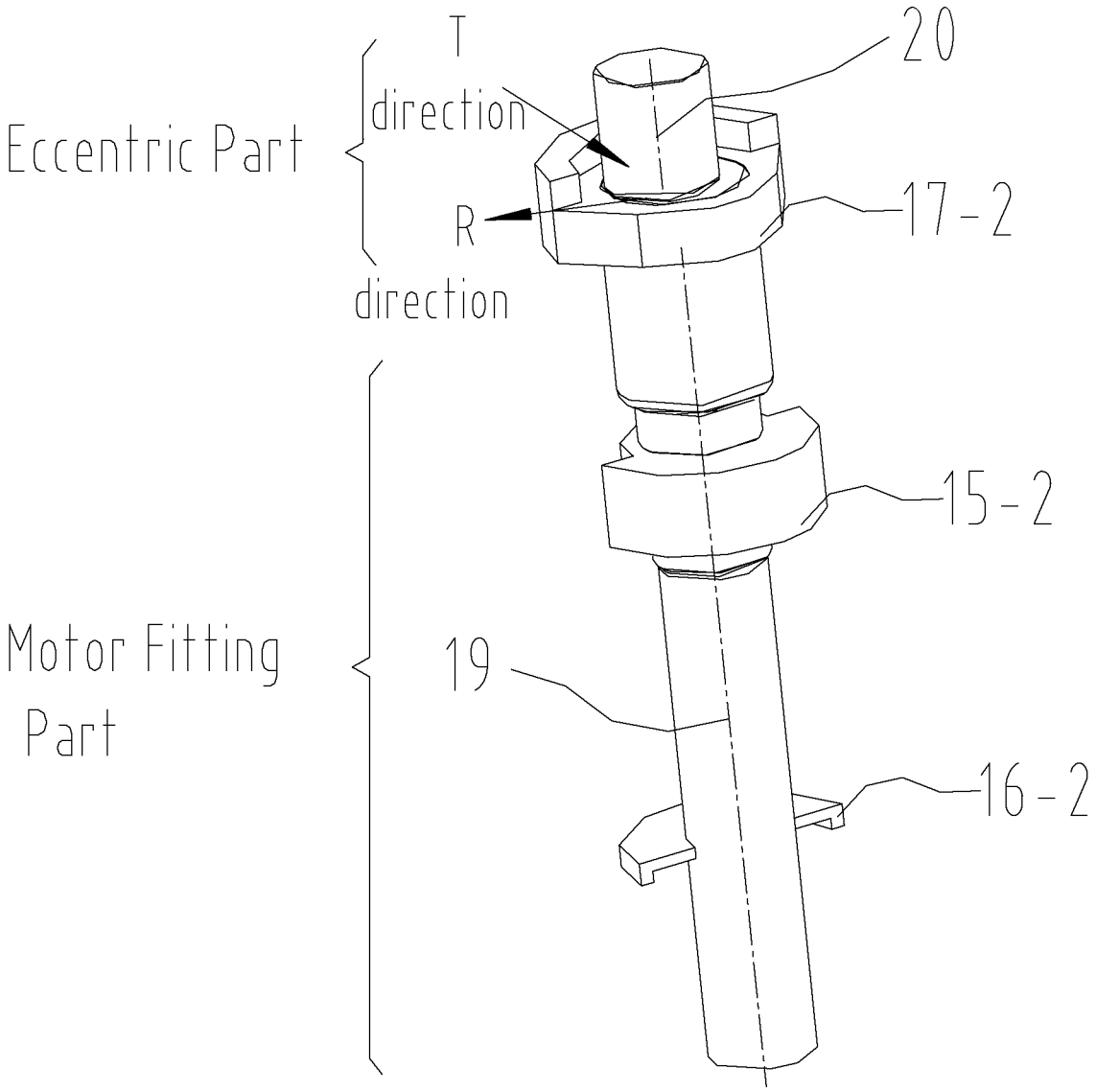
FIG. 6 is a schematic view illustrating a distribution of T-directional counterweights of the crankshaft according to an embodiment of the present disclosure.
Figure 7:
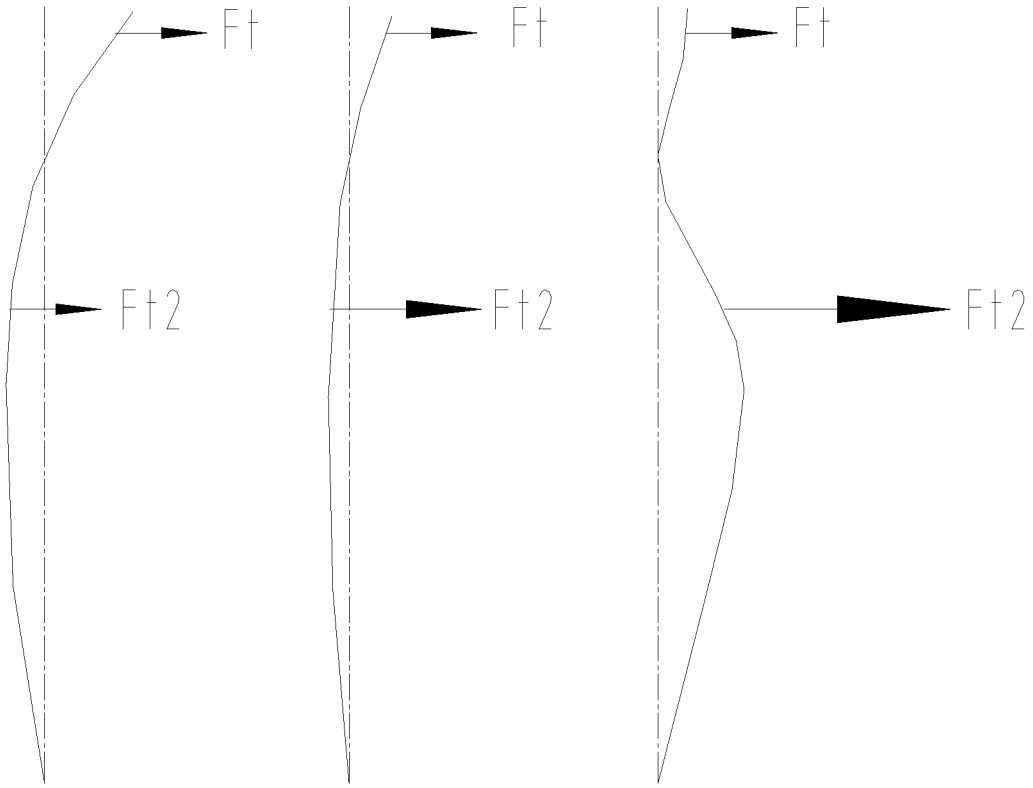
FIG. 7 is a schematic view illustrating flexure deformation under a T-directional centrifugal force according to an embodiment of the present disclosure.
Figure 8:
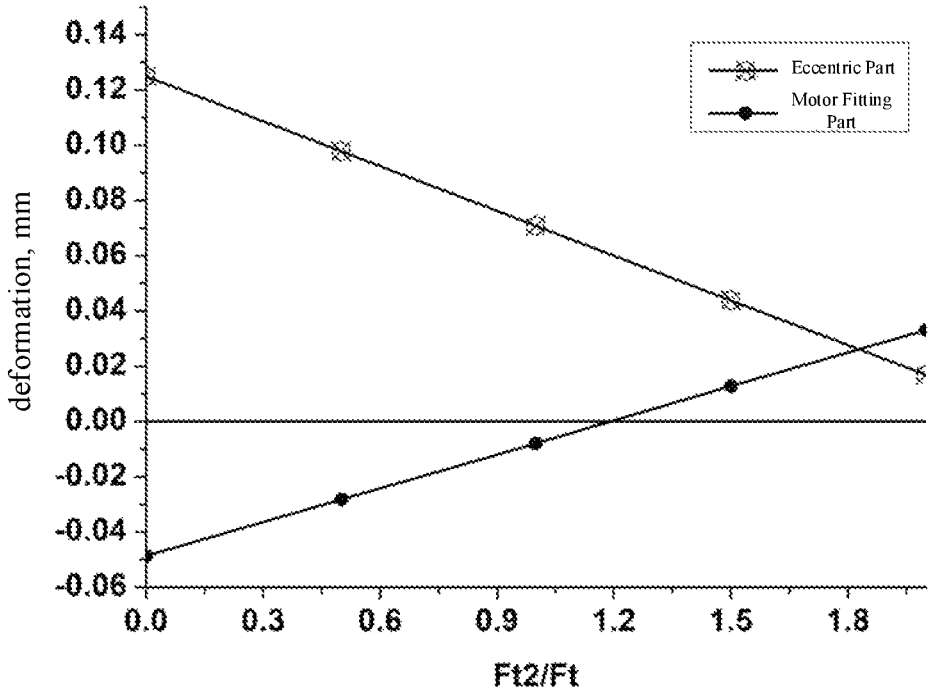
FIG. 8 is a view illustrating polygonal lines of calculated values of flexure deformation restrained by T-directional centrifugal forces according to an embodiment of the present disclosure.

FIG. 6 is a schematic view illustrating a distribution of T-directional counterweights of the crankshaft according to an embodiment of the present disclosure. As shown in FIG. 6, the gas force Ft affects the crankshaft deformation in the T direction of the crankshaft. A T-directional upper counterweight 17-2, a T-directional middle counterweight 15-2, and a T-directional lower counterweight 16-2 are provided. During operation, the centrifugal force generated by the T-directional upper counterweight 17-2 is Ft1, the centrifugal force generated by the T-directional middle counterweight 15-2 during operation is Ft2, and the centrifugal force generated by the T-directional lower counterweight 16-2 is Ft3. The direction of the centrifugal force Ft1 generated by the T-directional upper counterweight 17-2 is opposite to the direction of Ft. The direction of the centrifugal force Ft2 generated by the T-directional middle counterweight 15-2 is the same as the direction of Ft. The direction of the centrifugal force Ft3 generated by the T-directional lower counterweight 16-2 is opposite to the direction of Ft. Ft1, Ft2, and Ft3 satisfy the force balance and the moment balance in the T direction of the crankshaft. FIG. 7 is a schematic view illustrating flexure deformation under a T-directional centrifugal force according to an embodiment of the present disclosure. As shown in FIG. 7, the simple supporting beam structure is adopted, and the ANSYS software is used to calculate a deformation trend of the crankshaft in the T direction. FIG. 8 is a view illustrating polygonal lines of calculated values of flexure deformation restrained by T-directional centrifugal forces according to an embodiment of the present disclosure. As shown in FIG. 8, as the ratio of Ft2/Ft increases, the deformation component of the crankshaft firstly decreases and then increases. When Ft2/Ft=1.2, the deformation component of the motor fitting part is approximate to zero, and the deformation component of the eccentric part is relatively small. When Ft2/Ft>1.2, the "over-balance" occurs, and the increase in the centrifugal force and the increase in the mass of the middle counterweight provided in the same direction will aggravate the crankshaft deformation. In the embodiment of the present disclosure, the centrifugal force Ft2 generated by the T-directional middle counterweight is from 1 Ft to 1.2 Ft.

The counterweights in the R direction and in the T direction are integrated according to sizes and directions thereof. Fr1 and Ft1 are composed as the upper counterweight F1. Fr2 and Ft2 are composed as the middle counterweight F2. Fr3 and Ft3 are composed as the lower counterweight F3.

According to another aspect of the embodiments of the present disclosure, a crankshaft is further provided, and the crankshaft is provided with at least one counterweight disposed on the crankshaft. The counterweight is determined according to any one of the methods described above.

Optionally, the crankshaft includes an eccentric part provided with an eccentric shaft, and a motor fitting part. The eccentric part is provided with a first counterweight. The motor fitting part is provided with a second counterweight and a third counterweight. In the direction of the eccentric part of the crankshaft, the direction of the component centrifugal force of the first counterweight overcoming the orbiting scroll centrifugal force is opposite to the direction of the orbiting scroll centrifugal force, the direction of the component centrifugal force of the second counterweight overcoming the orbiting scroll centrifugal force is the same as the direction of the orbiting scroll centrifugal force, and the direction of the component centrifugal force of the third counterweight overcoming the orbiting scroll centrifugal force is opposite to the direction of the orbiting scroll centrifugal force. In the vertical direction perpendicular to the eccentric part of the crankshaft, the direction of the component centrifugal force of the first counterweight overcoming the gas force is opposite to the direction of the gas force, the direction of the component centrifugal force of the second counterweight overcoming the gas force is the same as the direction of the gas force, and the direction of the component centrifugal force of the third counterweight overcoming the gas force is opposite to the direction of the gas force.

Optionally, the first counterweight satisfies that Fr1 is ranged from 1.2 Fc to 1.5 Fc, where Fr1 is the magnitude of the component centrifugal force of the first counterweight overcoming the orbiting scroll centrifugal force, and Fc is the magnitude of the orbiting scroll centrifugal force.

Optionally, the second counterweight satisfies that Ft2 is ranged from 1 Ft to 1.2 Ft, where Ft2 is the magnitude of the component centrifugal force of the second counterweight overcoming the gas force, and Ft is the magnitude of the gas force.

According to another aspect of the embodiments of the present disclosure, a scroll compressor is further provided, and the scroll compressor includes the crankshaft of any one of the embodiments described above.

Figure 9:
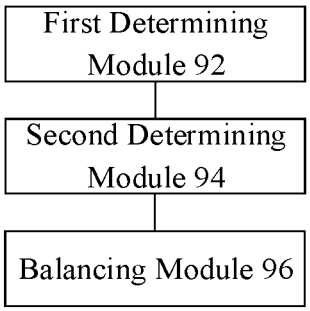
FIG. 9 is a-schematic view illustrating a device for balancing crankshaft deformation according to an embodiment of the present disclosure.

FIG. 9 is a schematic view illustrating a device for balancing crankshaft deformation according to an embodiment of the present disclosure. As shown in FIG. 9, according to another aspect of the embodiments of the present disclosure, a device for balancing crankshaft deformation is further provided, the device includes a first determining module 92 and a second determining module 94. The device will be described in detail below.

The first determining module 92 is configured to determine the component centrifugal force required for each counterweight to overcome the crankshaft deformation caused by the orbiting scroll centrifugal force and the gas force. The second determining module 94 is connected to the first determining module 92, and is configured to determine the counterweight according to the component centrifugal force. A balancing module 96 is connected to the second determining module 94 and configured to balance the crankshaft deformation by means of the counterweight. The counterweight is disposed on the crankshaft.

Through the device, the component centrifugal force required for each counterweight to overcome the crankshaft deformation caused by both the orbiting scroll centrifugal force and the gas force is determined by the first determining module 92, the counterweight is determined by the second determining module 94 according to the component centrifugal force, and the crankshaft deformation is balanced by the counterweight, where the counterweight is disposed on the crankshaft. By considering the superimposed effect of the orbiting scroll centrifugal force and the gas force on the crankshaft deformation, the counterweight is determined, thus achieving the purpose of enabling the counterweight to more accurately balance the crankshaft deformation, achieving the technical effect of improving the balance effect of the counterweight on the crankshaft deformation, and solving the technical problem that, in the related technology, only the influence of the orbiting scroll centrifugal force on the crankshaft is considered and the balance effect is poor.

According to another aspect of the embodiments of the present disclosure, a storage medium is further provided. The storage medium includes a stored program. When program is executed, a device where the storage medium is located is controlled to perform the method according to any one of the embodiments as described above.

According to another aspect of the embodiments of the present disclosure, a processor is further provided and configured to run a program. When the program is executed, the method of any one of the embodiments as described above is performed.

The serial numbers of the embodiments of the present disclosure are only for description, and do not represent the superiority or inferiority of the embodiments.

In the embodiments of the present disclosure, the description of each embodiment has its own emphasis. For a part that is not described in detail in an embodiment, reference may be made to related descriptions of other embodiments.

In the several embodiments provided in this disclosure, it should be understood that the disclosed technical content can be implemented in other ways. The device embodiments described above are merely illustrative. For example, the division of the units may be a logical function division, and there may be other divisions in actual implementation. For example, a plurality of units or components may be combined or may be integrated into another system, or some features may be omitted or not implemented. In addition, the displayed or discussed mutual coupling or direct coupling or communication connection may be an indirect coupling or a communication connection through some interfaces, units or modules, and may be in electrical or other forms.

The units described as force component components may be physically separated or not, and the components displayed as units may be physical units or not, that is, they may be located in one place, or they may be distributed on a plurality of units. Some or all of the units may be selected according to actual needs to achieve the objectives of the solutions of the embodiments.

In addition, the functional units in the various embodiments of the present disclosure may be integrated into one processing unit, or each unit may exist alone physically, or two or more units may be integrated into one unit. The integrated unit can be implemented in the form of hardware or software functional unit.

If the integrated unit is implemented in the form of the software functional unit and sold or used as an independent product, the integrated unit may be stored in a computer-readable storage medium. Based on this understanding, the technical solutions of the embodiments of the present disclosure are essentially or the part thereof that contributes to the related technology, or all or part of the technical solutions can be embodied in the form of software products. The computer software products are stored in a storage medium, and includes several instructions to enable a computer device (which may be a personal computer, a server, or a network device, etc.) to perform all or some of the steps of the methods described in the various embodiments of the present disclosure. The aforementioned storage media includes: U disk, read-only memory (ROM), random access memory (RAM), mobile hard disk, magnetic disk or optical disk and other media that may store program codes.

What described above are only the preferred implementations of the present disclosure. It should be noted that for those of ordinary skill in the art, several improvements and modifications may be made without departing from the principle of the embodiments of the present disclosure. These improvements and modifications should also be regarded as the protection scope of the embodiments of this disclosure.

INDUSTRIAL PRACTICAL APPLICABILITY

It may be an automation device for manufacturing crankshafts, or a computer or a control device that may control the automation device to determine the counterweights. Specifically, by determining the component centrifugal force required for each counterweight to overcome the crankshaft deformation caused by both the orbiting scroll centrifugal force and the gas force, the counterweight is determined according to the component centrifugal force, and the crankshaft deformation is balanced by the counterweight. By considering the superimposed effect of the orbiting scroll centrifugal force and the gas force on the crankshaft deformation, the counterweight is determined, and the automation device is instructed to process the crankshaft according to the determined counterweight, thereby improving the balance ability of the crankshaft, enabling the crankshaft to operate more stably, and solving the technical problem that, in the related technology, only the influence of the orbiting scroll centrifugal force on the crankshaft is considered and the balance effect of the counterweight of the crankshaft is poor.

What is claimed is:

1. A method for balancing crankshaft deformation, comprising:

determining a first crankshaft deformation caused by an orbiting scroll centrifugal force in a direction of an eccentric part of a crankshaft;

determining a second crankshaft deformation caused by a gas force of the crankshaft in a vertical direction perpendicular to the eccentric part of the crankshaft;

determining a component centrifugal force required for a counterweight to overcome the first crankshaft deformation caused by the orbiting scroll centrifugal force and the second crankshaft deformation caused by the gas force;

determining the counterweight according to the component centrifugal force; and balancing the first crankshaft deformation and the second crankshaft deformation by the counterweight; wherein the counterweight is arranged on the crankshaft;

wherein the determining the component centrifugal force required for the counterweight to overcome the first crankshaft deformation caused by the orbiting scroll centrifugal force and the second crankshaft deformation caused by the gas force comprises:

preliminarily determining a direction and a magnitude of the component centrifugal force required for the counterweight to overcome the orbiting scroll centrifugal force or the gas force according to the orbiting scroll centrifugal force or the gas force;

carrying out a simulation by a simulation software, and adjusting the magnitude of the component centrifugal force to change the first deformation or the second deformation output by the simulation software; and determining the magnitude of the component centrifugal force corresponding to the orbiting scroll centrifugal force or corresponding to the gas force, when the first deformation or the second deformation reaches a preset value;

wherein the carrying out the simulation by the simulation software and adjusting the magnitude of the component centrifugal force to change the first deformation or the second deformation output by the simulation software comprises:

adjusting a ratio of the component centrifugal force to the orbiting scroll centrifugal force or to the gas force to adjust the magnitude of the component centrifugal force; and according to the adjusted component centrifugal force, changing the first deformation or the second deformation output by the simulation software.

2. The method of claim 1, before the determining the component centrifugal force required for the counterweight to overcome the first crankshaft deformation caused by the orbiting scroll centrifugal force and the second crankshaft deformation caused by the gas force, further comprising:

determining the number and positions of counterweights on the crankshaft according to operating conditions of the crankshaft;

wherein the operating conditions comprises at least one of an actual operating condition and a type of the crankshaft.

3. The method of claim 2, wherein the actual operating condition comprises a rotational speed of the crankshaft and a rotational speed of a motor that drives the crankshaft.

4. The method of claim 1, wherein the preliminarily determining the direction and the magnitude of the component centrifugal force required for the counterweight to overcome the orbiting scroll centrifugal force or the gas force according to the orbiting scroll centrifugal force or the gas force comprises:

determining the direction of the component centrifugal force according to the orbiting scroll centrifugal force or the gas force, wherein on the eccentric part of the crankshaft, a direction of the orbiting scroll centrifugal force is opposite to a direction of a component centrifugal force of an adjacent counterweight, and directions of the component centrifugal forces of two adjacent counterweights are opposite to each other; in the vertical direction perpendicular to the eccentric part of the crankshaft, a direction of the gas force is the same as a direction of a component centrifugal force of an adjacent counterweight, and directions of the component centrifugal forces of two adjacent counterweights are opposite to each other; and according to a moment balance and a force balance between the orbiting scroll centrifugal force or the gas force and the component centrifugal force, preliminarily determining the magnitude of the component centrifugal force required for the counterweight to overcome the orbiting scroll centrifugal force or the gas force.

5. The method of claim 1, wherein the determining the magnitude of the component centrifugal force corresponding to the orbiting scroll centrifugal force or corresponding to the gas force when the first deformation or the second deformation reaches the preset value comprises:

determining whether the first deformation or the second deformation is in a preset threshold range; and if the first deformation or the second deformation is in the preset threshold range, determining the magnitude of the component centrifugal force corresponding to the orbiting scroll centrifugal force or corresponding to the gas force.

6. The method of claim 5, wherein the preset threshold range is from −0.02 mm to 0.02 mm, from −0.01 mm to 0.01 mm, or from 0.01 mm to 0.02 mm.

7. A non-transitory storage medium, comprising a stored program, wherein when the program is executed, a device where the storage medium is located is controlled to perform the method of claim 1.

8. A processor, configured to run a program, wherein when the program is executed, the method of claim 1 is performed.

9. The method of claim 1, wherein the determining the component centrifugal force required for the counterweight to overcome the first crankshaft deformation caused by the orbiting scroll centrifugal force and the second crankshaft deformation caused by the gas force comprises:

determining a resultant force of the orbiting scroll centrifugal force and the gas force, and determining the component centrifugal force required for the counterweight to overcome the resultant force.

10. The method of claim 1, wherein before carrying out the simulation by the simulation software, an adjusted object is determined according to a relationship between the first deformation or the second deformation and the component centrifugal force.

11. The method of claim 10, wherein the first deformation or the second deformation is proportional to a square of the component centrifugal force, and the square of the component centrifugal force serves as the adjusted object.

12. A method for balancing crankshaft deformation, comprising:

determining a first crankshaft deformation caused by an orbiting scroll centrifugal force in a direction of an eccentric part of a crankshaft;

determining a second crankshaft deformation caused by a gas force of the crankshaft in a vertical direction perpendicular to the eccentric part of the crankshaft;

determining a component centrifugal force required for a counterweight to overcome the first crankshaft deformation caused by the orbiting scroll centrifugal force and the second crankshaft deformation caused by the gas force;

determining the counterweight according to the component centrifugal force; and balancing the first crankshaft deformation and the second crankshaft deformation by the counterweight; wherein the counterweight is arranged on the crankshaft;

wherein the determining the component centrifugal force required for the counterweight to overcome the first crankshaft deformation caused by the orbiting scroll centrifugal force and the second crankshaft deformation caused by the gas force comprises:

preliminarily determining a direction and a magnitude of the component centrifugal force required for the counterweight to overcome the orbiting scroll centrifugal force or the gas force according to the orbiting scroll centrifugal force or the gas force;

carrying out a simulation by a simulation software, and adjusting the magnitude of the component centrifugal force to change the first deformation or the second deformation output by the simulation software; and determining the magnitude of the component centrifugal force corresponding to the orbiting scroll centrifugal force or corresponding to the gas force, when the first deformation or the second deformation reaches a preset value;

wherein before carrying out the simulation by the simulation software, an adjusted object is determined according to a relationship between the first deformation or the second deformation and the component centrifugal force; and wherein the first deformation or the second deformation is proportional to a square of the component centrifugal force, and the square of the component centrifugal force serves as the adjusted object.

* * * * *